US009228301B2

(12) United States Patent
Lathan et al.

(10) Patent No.: US 9,228,301 B2
(45) **Date of Patent: *Jan. 5, 2016**

(54) ELONGATE PIPE-BASED STRUCTURE FOR SUPPORTING HEAVY LOADS

(71) Applicants: Kevin Edward Lathan, Clearwater, FL (US); Valery Tsimmerman, Brookeville, MD (US)

(72) Inventors: Kevin Edward Lathan, Clearwater, FL (US); Valery Tsimmerman, Brookeville, MD (US)

(73) Assignee: Omega Trestle LLC, Clearwater, FL (US)

( * ) Notice: Subject to any disclaimer, the term of this patent is extended or adjusted under 35 U.S.C. 154(b) by 71 days.

This patent is subject to a terminal disclaimer.

(21) Appl. No.: 14/095,298

(22) Filed: Dec. 3, 2013

(65) Prior Publication Data

US 2015/0152609 A1 Jun. 4, 2015

(51) Int. Cl.

| | |
|---|---|
| ***E01D 19/00*** | (2006.01) |
| ***E01D 2/00*** | (2006.01) |
| ***E04C 3/04*** | (2006.01) |
| ***E01D 15/12*** | (2006.01) |
| ***E01D 19/12*** | (2006.01) |

(52) U.S. Cl.

CPC *E01D 2/00* (2013.01); *E01D 15/12* (2013.01); *E01D 19/125* (2013.01); *E04C 3/04* (2013.01); *E04C 2003/0413* (2013.01); *E04C 2003/0439* (2013.01); *E04C 2003/0447* (2013.01); *E04C 2003/0452* (2013.01); *E04C 2003/0465* (2013.01)

(58) Field of Classification Search

CPC ..... E01D 19/00; E01D 2/00; E01D 2/04; E04C 3/30

USPC ..... 14/77.1, 73, 74.5, 75; 405/184.5, 405/124–126, 218–221; 52/FOR. 144, 52/FOR. 136, FOR. 129, FOR. 130, 52/843–845; 249/48

See application file for complete search history.

(56) References Cited

U.S. PATENT DOCUMENTS 8,573,556 B1 * 11/2013 Baker et al. ..... 249/48

FOREIGN PATENT DOCUMENTS

| | | | |
|---|---|---|---|
| JP | 05118134 A | * | 5/1993 |
| KR | 101229472 | | 2/2013 |
| KR | 101329440 | | 11/2013 |

OTHER PUBLICATIONS

International Search Report and Written Opinion issued Mar. 23, 2015 for corresponding international PCT patent application No. PCT/US2014/068051 with an international filed of Dec. 2, 2014.

(Continued)

*Primary Examiner* — Sunil Singh

(74) *Attorney, Agent, or Firm* — Ronald E. Smith; Nicholas Pfeifer; Smith & Hopen, P.A.

(57) ABSTRACT

An elongate structure for supporting heavy loads includes an elongate hollow cylinder having a longitudinal axis of symmetry. Stress-distributing strengthening members are circumferentially positioned about and secured to the hollow cylinder in parallel relation to the longitudinal axis of symmetry. A first flat plate is disposed in overlying relation to the hollow cylinder and to the first, upper pair of strengthening members and a second flat plate is disposed in underlying relation to the hollow cylinder and to the second, lower pair of strengthening members. The second flat plate is disposed in a horizontal plane in parallel and diametrically opposed relation to the first flat plate. A key extends from a first end of the hollow cylinder and a mating socket is formed in a second end of the hollow cylinder to facilitate end-to-end interconnection of a plurality of the hollow cylinders.

6 Claims, 6 Drawing Sheets

(56) References Cited

OTHER PUBLICATIONS

English abstract for Korean Patent No. 10-1229472 B1 issued Feb. 7, 2013. Abstract retrieved from KIPO website, http://engpat.kipris.or.kr/engpat/searchLogina.do?next=MainSearch&checkPot=Y, on Apr. 21, 2015.

English abstract for Korean Patent No. 10-1329440 issued Nov. 14, 2013. Abstract retrieved from KIPO website, http://engpat.kipris.or.kr/engpat/searchLogina.do?next=MainSearch&checkPot=Y, on Apr. 21, 2015.

* cited by examiner

ELONGATE PIPE-BASED STRUCTURE FOR SUPPORTING HEAVY LOADS

BACKGROUND OF THE INVENTION

1. Field of the Invention

This invention relates, generally, to temporary structures for supporting heavy loads over bodies of water or wetlands. More particularly, it relates to a modular heavy load-supporting structure having cylindrical sections that can be laid end to end quickly to save time and materials.

2. Description of the Prior Art

It was a common practice before wetlands conservation was a concern to dredge out large sections of wetlands as needed when building roadways or bridges over such wetlands. Such dredging enabled barges to carry heavy equipment to the jobsite as the job site progressed across the landscape.

Over time, it became apparent that dredged wetlands were not recovering as expected, and laws were passed to ban such dredging.

Stone causeways were also built in wetlands areas to avoid such dredging, but they too were determined to be environmentally intrusive.

The industry thus adopted the practice of building a temporary bridge into the wetlands for the purpose of enabling heavy equipment to reach the job site. Although such bridges require pile driving, it was found that the small footprint of a pile caused no permanent damage to the wetlands, i.e., the wetlands were observed to recover quickly when the temporary piles were removed.

The primary drawback to the temporary bridge solution to the wetlands conservation problem is that such temporary bridges, since they must carry very heavy loads, can be quite expensive and time-consuming to build even though they are temporary structures that are removed when the main roadway or bridge is completed.

Thus there is a need for a temporary bridge structure that can be assembled quickly from low cost materials but which can support extremely heavy loads.

There is also a need for a temporary bridge structure that can be quickly disassembled as well when no longer needed.

However, in view of the art considered as a whole at the time the present invention was made, it was not obvious to those of ordinary skill in the art how the needed structure could be provided.

SUMMARY OF THE INVENTION

The long-standing but heretofore unfulfilled need for an improved structure for a temporary structure that supports heavy loads is now met by a new, useful, and non-obvious invention.

The inventive structure includes a hollow cylinder having a longitudinal axis of symmetry and an elongate extent. A plurality of stress-distributing strengthening members is circumferentially positioned about and secured to the hollow cylinder in parallel relation to the longitudinal axis of symmetry.

The strengthening members have an extent substantially equal to the elongate extent of the elongate hollow cylinder and each strengthening member has an "L" shape where the legs of the "L" are disposed in normal relation to one another.

Each leg of each strengthening member has a free end disposed in abutting and secured relation to the hollow cylinder along the elongate extent of the hollow cylinder.

A first flat plate of rigid construction is disposed in a horizontal plane in overlying and secured relation to the hollow cylinder and to the first, upper pair of strengthening members.

A second flat plate of rigid construction is disposed in a horizontal plane in underlying and secured relation to the hollow cylinder and to the second, lower pair of strengthening members in parallel and diametrically opposed relation to the first flat plate.

An imperforate first circular disc is positioned within the lumen of the hollow cylinder in perpendicular relation to the longitudinal axis of symmetry of the hollow cylinder and in longitudinally spaced relation to a preselected end of the hollow cylinder.

A second circular disc has a central opening formed therein secured to a first end of the hollow cylinder and a third circular disc has a central opening formed therein and is secured to a second, opposite end of the hollow cylinder.

A truncate cylindrical member has a first end secured to the first circular disc in concentric relation thereto and has a second end protruding through the central opening formed in the second circular disc, said protrusion forming a key.

The central opening of the third circular disc forms a socket that mates with the key when first and second hollow cylinder members are disposed in end-to-end abutting relation to one another along a common longitudinal axis of symmetry.

An important object of the invention is to provide a temporary bridge structure capable of supporting extremely heavy equipment.

Another important object is to provide such a structure that can be made of any length.

Still further objects include the provision of a structure that can be assembled quickly, without tight tolerances, and which is made from readily available materials.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
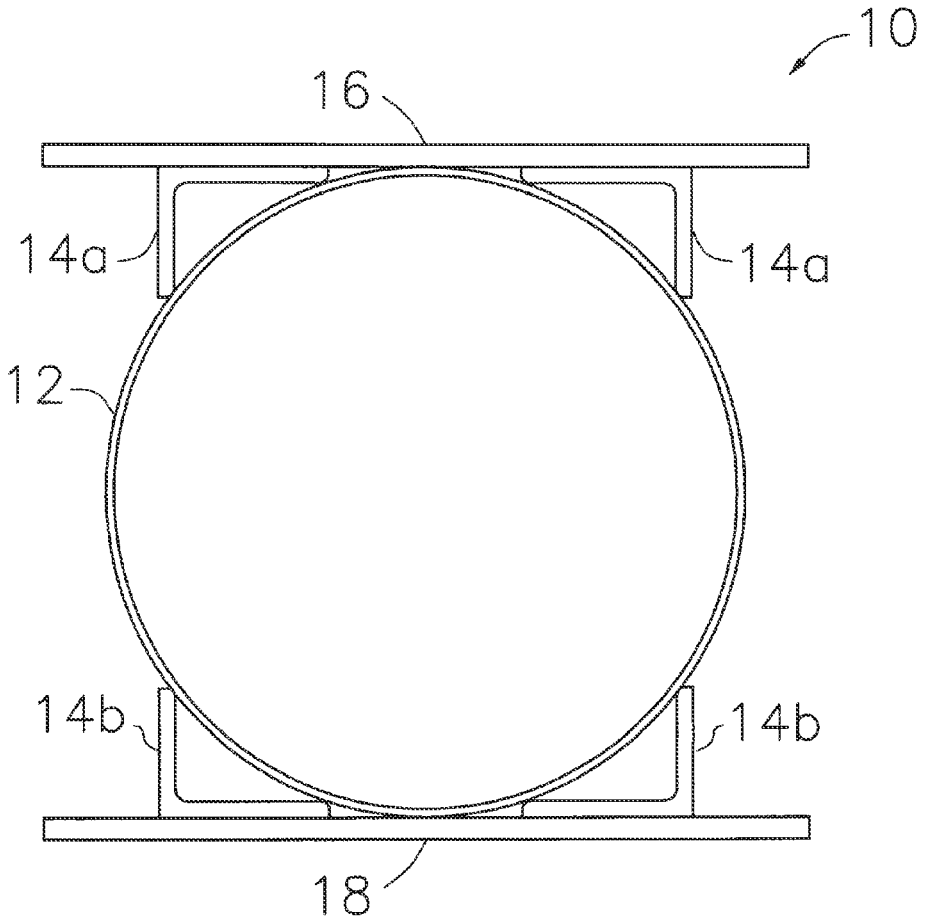
FIG. 1 is an end view of the novel structure.

FIG. 1 depicts an illustrative embodiment of a novel structural flexural element which is denoted as a whole by the reference numeral 10.

The novel structure includes elongate hollow pipe or cylinder 12 having a longitudinal axis of symmetry. Four (4)

elongate, generally L-shaped stress-distributing strengthening members, denoted 14*a*, 14*a*, 14*b*, and 14*b* are circumferentially positioned about hollow cylinder 12 in parallel relation to said longitudinal axis of symmetry. The legs of the "L" are disposed in normal relation to one another and the respective free ends of the legs abut elongate cylinder 12 along their respective extents and are welded or otherwise secured to said elongate cylinder.

A first flat plate 16 of rectangular configuration and rigid construction overlies cylinder member 12 and the first or upper pair 14*a*, 14*a* of the strengthening members is positioned relative to one another to orient said first flat plate 16 in a horizontal plane. First flat plate 16 is welded or otherwise secured to each member of the first pair of strengthening 14*a*, 14*a*.

A second flat plate 18 of rectangular configuration underlies cylinder member 12 and the second or lower pair of stress-distributing strengthening members 14*b*, 14*b* is positioned to orient said second flat plate 18 in a horizontal plane. Second flat plate 18 is welded or otherwise secured to each member of the second pair of strengthening members 14*b*, 14*b*.

First and second flat plates 16 and 18 respectively are therefore parallel to one another in their respective horizontal planes.

Figure 2:
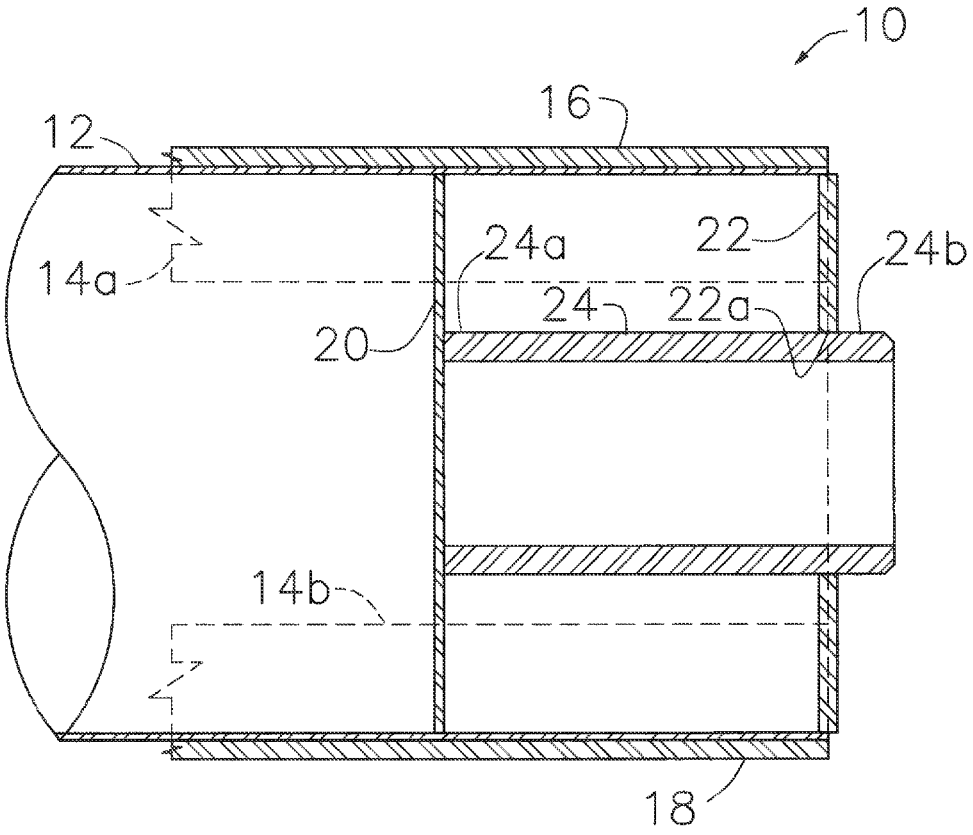
FIG. 2 is a longitudinal sectional view of a first, protruding or male end.

FIG. 2 depicts imperforate first circular disc 20 positioned within the lumen of hollow cylinder 12 in perpendicular relation to the longitudinal axis of symmetry of said hollow cylinder.

A second circular disc 22 having central opening 22*a* formed therein is secured to a first end of hollow cylinder 12 as depicted in FIG. 2, and a third circular disc 22, also having central opening 22*a*, not depicted in FIG. 2, is secured to a second, opposite end of hollow cylinder 12 in closing relation thereto.

Truncate cylindrical member 24 has a first end 24*a* secured to first circular disc 20 in concentric relation thereto, i.e., truncate cylindrical member 24 has the same longitudinal axis of symmetry as does elongate cylinder 12. Second end 24*b* of truncate cylindrical member 24 extends through central opening 22*a* formed in said second circular disc 22 as depicted in FIG. 2. The protrusion of second end 24*b* forms a key or pin that mates with a socket formed in another cylindrical disc, not depicted in FIG. 2, when two (2) cylindrical members 12 are disposed in end-to-end abutting relation to one another along a common longitudinal axis of symmetry.

Thus a first end of each hollow cylindrical member 12 is provided with key or pin 24*b* as depicted in FIG. 2 and the second end of each hollow cylindrical member, not depicted in FIG. 2, is provided with a key-receiving socket.

Figure 3:
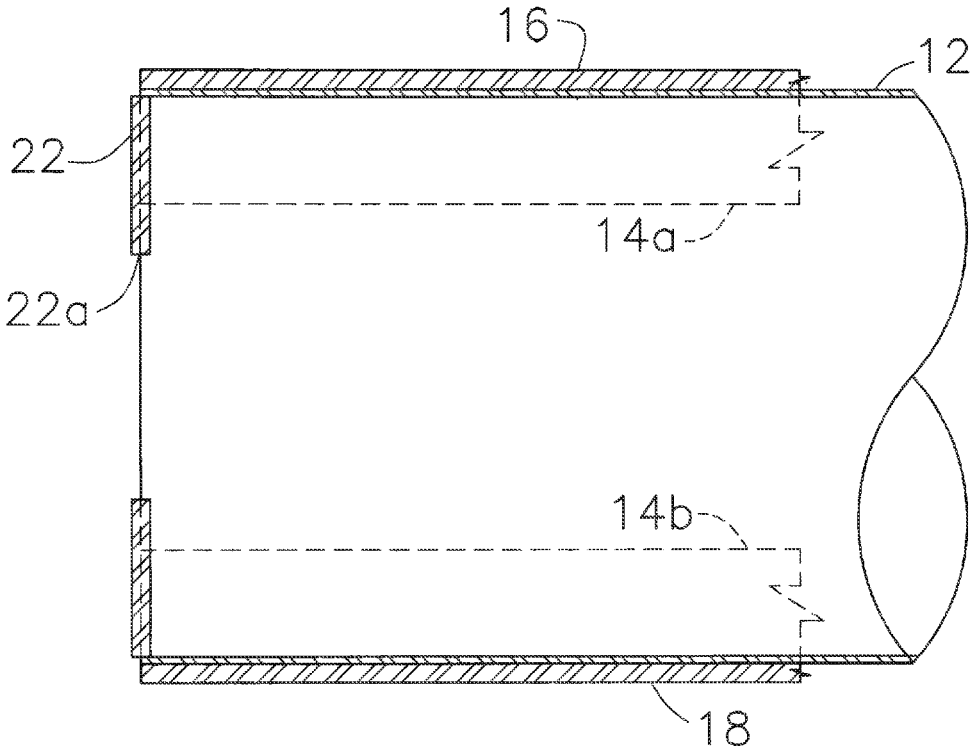
FIG. 3 is a longitudinal sectional view of a second, socket or female end.

FIG. 3 depicts a second end of hollow cylinder 12. The socket is provided in the form of the central opening 22*a* formed in circular disc 22. The diameter of central opening 22*a* is just slightly greater than the external diameter of key 24*b*. This facilitates the easy interconnection of large numbers of cylindrical members 12 in an elongate configuration.

Figure 4:
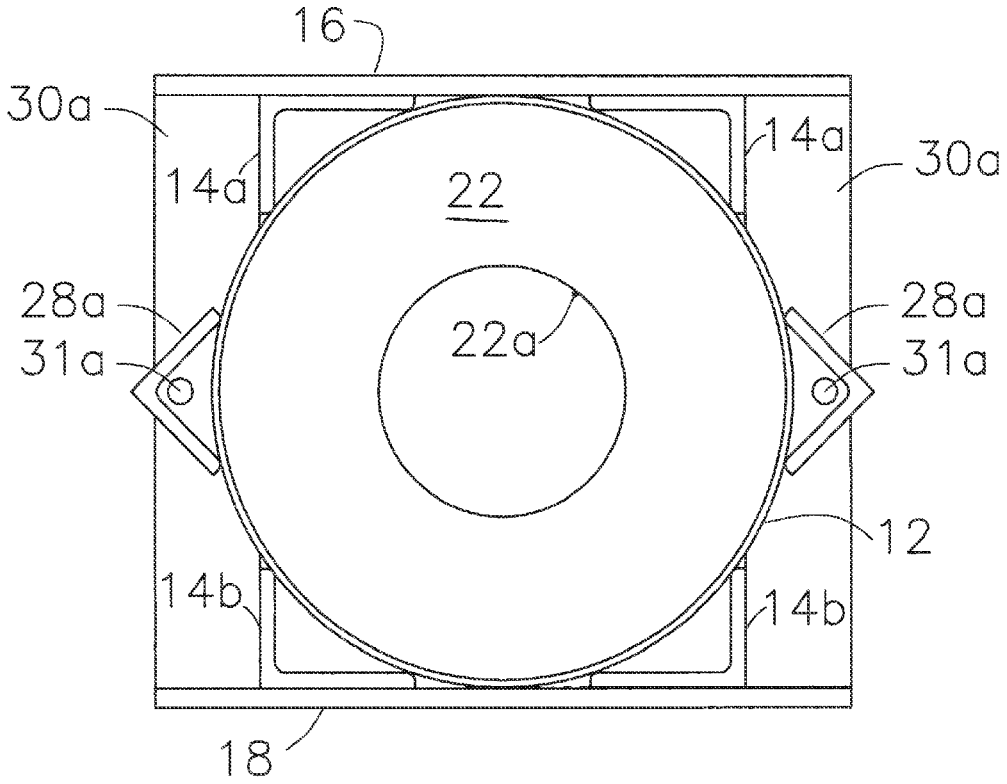
FIG. 4 is an end view of the socket end.

FIG. 4 is an end view of the fully assembled preferred embodiment of the invention from the socket or female end. Four (4) additional L-shaped braces 28*a*, 28*a*, 28*b*, and 28*b*, only two (2) of which can be seen in end view, having a structure like strengthening members 14*a*, 14*a*, 14*b*, and 14*b*, are secured to elongate hollow cylinder 12.

Defining the end view of cylinder member 12 as the face of an analog clock where twelve o'clock is the highest point of said cylinder member as drawn in said FIG. 4, braces 28*a*, 28*a* are diametrically opposed to one another at the three o'clock and the nine o'clock positions, i.e., braces 28*a*, 28*a* are positioned mid-way between first and second flat plates 16 and 18. Braces 28*a*, 28*a* have a common longitudinal extent but do not extend the entire extent of hollow cylinder member 12.

The undepicted braces 28*b*, 28*b* are positioned at the same three o'clock and nine o'clock positions at an opposite end of hollow cylinder member 12 in longitudinally spaced apart relation to braces 28*a*, 28*a*, respectively. Braces 28*b*, 28*b* have a common longitudinal extent, but like braces 28*a*, 28*a* do not extend the entire extent of hollow cylindrical member 12.

A first pair of flat plates 30*a*, 30*a* interconnect first and second flat plates 16 and 18 to one another at a first end thereof as depicted in FIG. 4. A second pair of flat plates 30*b*, 30*b*, not depicted in FIG. 4, interconnect first and second flat plates 16 and 18 to one another at a second end thereof.

The first pair of flat plates 30*a*, 30*a* is connected to L-shaped strengthening members 14*a*, 14*a*, 14*b*, and 14*b* and to braces 28*a*, 28*a*. The second pair of flat plates 30*b*, 30*b* is connected to L-shaped strengthening members 14*a*, 14*a*, 14*b*, and 14*b* and to braces 28*b*, 28*b*.

Each flat plate 30*a*, 30*a*, 30*b*, 30*b* is preferably centrally apertured as at 31*a*, 31*a*, 31*b*, 31*b*. Each of said apertures is therefore framed by an associated brace 28*a*, 28*a*, 28*b*, 28*b* when observed in end view as depicted in FIG. 4. Apertures 31*a*, 31*a*, 31*b*, 31*b* enable the interconnection of adjacent pipe beams with elongate threaded rods, not depicted, that extend through said apertures in order to prevent disengagement of the above-disclosed male/female connections.

Figure 5:
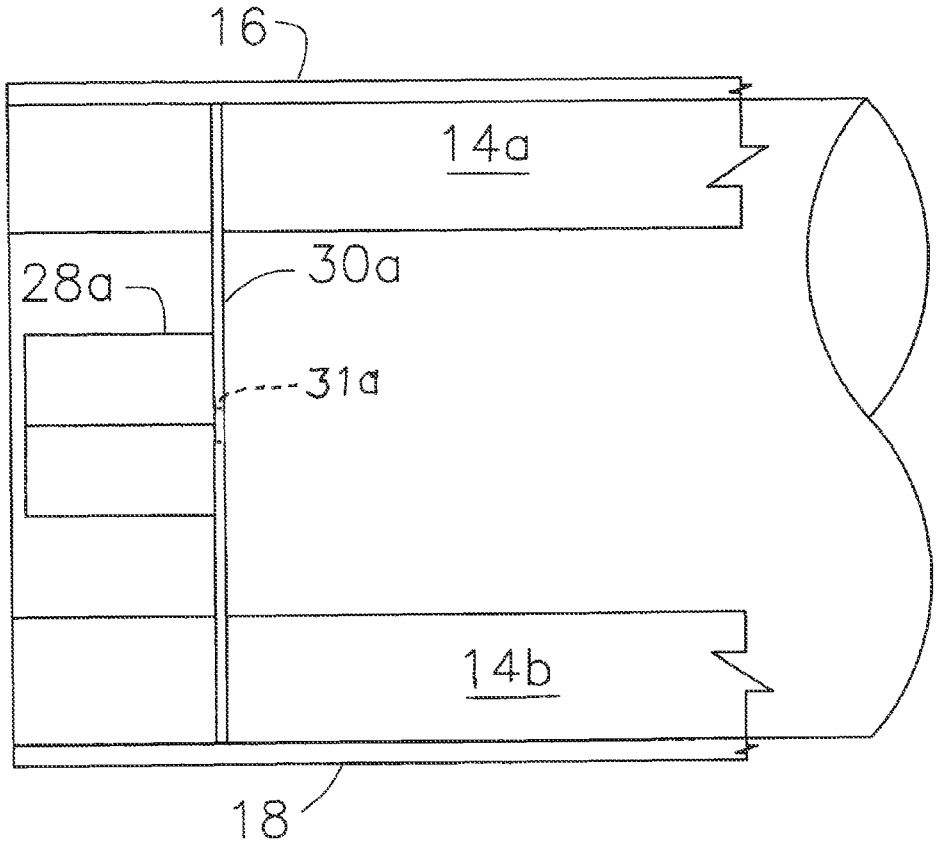
FIG. 5 is a partial side elevational view of the novel structure.

The respective positions of braces 28*a*, 28*a*, 28*b* and 28*b* is best understood in connection with the partial side elevational view of FIG. 5. This view depicts one of the braces 28*a* and one of the flat plates 30*a*. Matching brace 28*a* and matching flat plate 30*a* are not depicted in this view but are understood to be diametrically opposed from the depicted plate and brace. Braces 28*b*, 28*b* are thus understood to be diametrically opposed to one another at the opposite end of said hollow cylindrical member, as are flat plates 30*b*, 30*b*.

Figure 6:
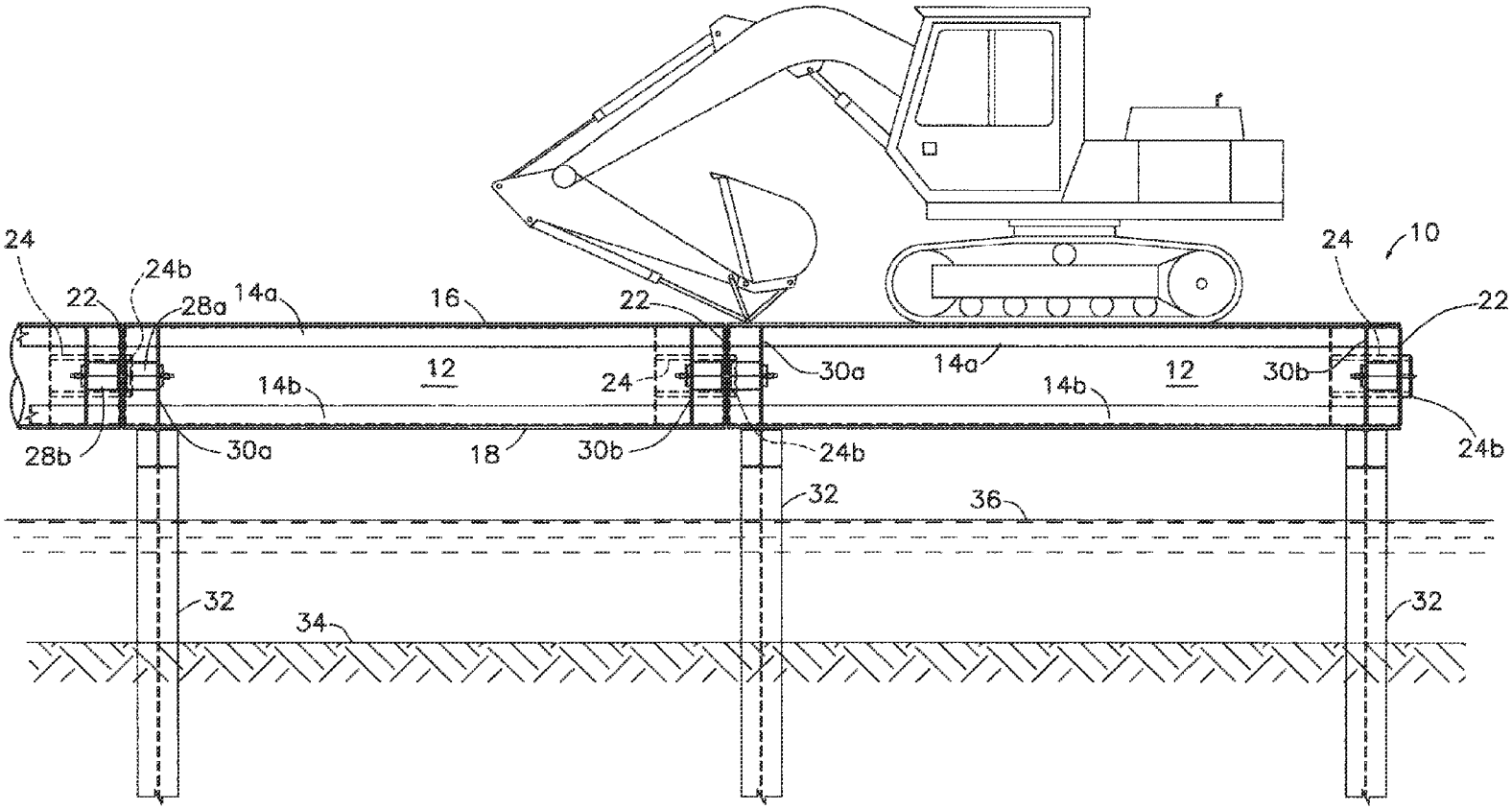
FIG. 6 is a side elevational view of the novel structure in use.

FIG. 6 depicts a novel temporary bridge structure made in accordance with this disclosure. Piles, collectively denoted 32, are driven into the earth 34 in a conventional way at longitudinally spaced apart intervals and extend above a water surface 36 by a predetermined distance. Cylinder members 12 are laid in end-to-end relation to one another, sandwiched between flat plates 16, 18 and strengthened by strengthening members 14*a*, 14*b* along the extent thereof.

Structure 10 safely supports heavy equipment such as an excavator, crane, loader, cherry picker and the like, as depicted.

It is important to observe that the parting line between abutting cylinders 12 need not be positioned directly above a piling 32 as required in prior art constructions. The reference numeral 22 designates a circular disc having a central opening or socket that is positioned at each end of each cylinder 12. Therefore it is clear that said reference numeral 22 also indicates the parting line between cylinders 12 that are disposed in end-to-end, abutting relation to one another. As depicted in FIG. 6, no parting line 22 is positioned above a piling 32, i.e., each parting line 22 is laterally offset from each piling 32. In other words, each parting line 22 is in cantilevered relation to piling 32.

This highly novel feature is a result of the pin/socket structure disclosed herein. The joint formed by the highly novel pin/socket structure is so strong that it need not be directly supported by an underlying piling 32. No prior art structure capable of bearing extremely heavy loads includes joints that may be offset from the pilings that support the structure.

The invention still works if one or more parting lines 22 are in vertical alignment with any part of a pile 32, but the critical point is that such alignment is not required. This enables a structure using the novel cylinder members 12 to be quickly assembled, there being no need to carefully position each parting line in vertical alignment with a piling, i.e., there being no need to carefully space each piling so that each piling supports a trailing end of one cylinder and a leading end of another cylinder.

The use of cylinders 12 is also important because the beams used in prior art temporary structures are not readily available in the commercial marketplace. Cylinder members of the type used in the novel structure are inexpensive and widely available. Since they are used primarily in temporary structures, they can be re-used multiple times, circulating through the industry that is dedicated to the building of temporary structures that can support heavy loads.

Although FIG. 6 depicts a trestle application, the invention is not limited to the building of such trestles. There are numerous other applications to which the novel structure may be put.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An elongate structure for supporting heavy loads, comprising:

a hollow cylinder having a longitudinal axis of symmetry and an elongate extent;

a plurality of stress-distributing strengthening members circumferentially positioned about and secured to said hollow cylinder in parallel relation to said longitudinal axis of symmetry, said strengthening members having an extent substantially equal to the elongate extent of said elongate hollow cylinder;

each strengthening member having an "L" shape where the legs of the "L" are disposed in normal relation to one another;

each leg of each strengthening member having a free end disposed in abutting and secured relation to said hollow cylinder along the elongate extent of said hollow cylinder;

a first flat plate of rigid construction disposed in overlying and secured relation to said hollow cylinder and to a first, upper pair of strengthening members, said first flat plate being disposed in a horizontal plane;

a second flat plate of rigid construction disposed in underlying and secured relation to said hollow cylinder and to a second, lower pair of strengthening members, said second flat plate being disposed in a horizontal plane in parallel and diametrically opposed relation to said first flat plate.

2. The elongate structure of claim 1, further comprising:

an imperforate first circular disc positioned within the lumen of said hollow cylinder in perpendicular relation of the longitudinal axis of symmetry of said hollow cylinder and in longitudinally spaced relation to a preselected end of said hollow cylinder;

a second circular disc having a central opening formed therein secured to a first end of said hollow cylinder;

a third circular disc having a central opening formed therein secured to a second end of said hollow cylinder opposite of said first end of said hollow cylinder;

a truncate cylindrical member having a first end secured to said first circular disc in concentric relation thereto;

said truncate cylindrical member having a second end protruding through the central opening formed in said second circular disc;

said protrusion of said second end forming a pin;

said central opening of said third circular disc forming a socket;

a pin formed in a first hollow cylinder;

a socket formed in a second hollow cylinder having a size and shape such that said pin mates with said socket when first and second hollow cylinder members are disposed in end-to-end abutting relation to one another along a common longitudinal axis of symmetry.

3. The elongate structure of claim 2, further comprising:

a first pair of L-shaped side braces disposed in diametrically opposed relation to one another on opposite sides of said hollow cylinder near said first end of said hollow cylinder, each side brace of said first pair being about mid-way between said first and second plates;

a second pair of L-shaped side braces disposed in diametrically opposed relation to one another on opposite sides of said hollow cylinder near said second end of said hollow cylinder, each side brace of said second pair being about mid-way between said first and second plates.

4. The elongate structure of claim 3, further comprising:

a first pair of flat plates disposed in interconnecting relation between said first and second flat plates at said first end of said hollow cylinder;

a second pair of flat plates disposed in interconnecting relation between said first and second flat plates at said second end of said hollow cylinder;

said first pair of flat plates being connected to each of said L-shaped strengthening members and to each of said side braces at said first end of said hollow cylinder;

said second pair of flat plates being connected to each of said L-shaped strengthening members and to each of said side braces at said second end of said hollow cylinder.

5. The elongate structure of claim 4, further comprising:

each of said flat plates of said first pair and second pair of flat plates being centrally apertured;

each of said apertures being framed by an associated side brace.

6. The elongate structure of claim 2, further comprising:

at least one upstanding piling for supporting at least two elongate cylinders disposed in abutting, end-to-end relation to one another;

a parting line formed where said at least two elongate cylinders abut one another;

said parting line being laterally offset from said at least one upstanding piling.

* * * * *